US006540209B2

(12) United States Patent
Ross

(10) Patent No.: US 6,540,209 B2
(45) Date of Patent: Apr. 1, 2003

(54) PORTABLE SAFETY FENCE SYSTEM FOR CONSTRUCTION SITES

(75) Inventor: Cheryl Ross, 17364 Walnut Grove Dr., Morgan Hill, CA (US) 95037

(73) Assignee: Cheryl Ross, Morgan Hill, CA (US)

( * ) Notice: Subject to any disclaimer, the term of this patent is extended or adjusted under 35 U.S.C. 154(b) by 17 days.

(21) Appl. No.: 09/820,738

(22) Filed: Mar. 30, 2001

(65) Prior Publication Data

US 2001/0045555 A1 Nov. 29, 2001

Related U.S. Application Data

(60) Provisional application No. 60/193,562, filed on Mar. 31, 2000.

(51) Int. Cl.[7] ..... E04H 17/14

(52) U.S. Cl. ..... 256/68; 256/65.14; 256/73; 256/1; 256/DIG. 6

(58) Field of Search ..... 256/24, 26, 65.01, 256/68, 69, 73, 59, DIG. 6, 65.14, 1; 403/341, 286, 293; 52/585.1, 584.1, 698; 248/224.7, 224.8

(56) References Cited

U.S. PATENT DOCUMENTS

| | | | | | |
|---|---|---|---|---|---|
| 3,480,257 | A | * | 11/1969 | Bourn et al. | 182/113 |
| 3,632,089 | A | * | 1/1972 | Smith | 256/1 |
| 3,863,899 | A | | 2/1975 | Werner | |
| 3,863,900 | A | * | 2/1975 | Dagiel et al. | 248/231.71 |
| 3,867,997 | A | | 2/1975 | Hyslop, Jr. | |
| 3,920,221 | A | * | 11/1975 | Berry et al. | 256/59 |
| 4,145,031 | A | * | 3/1979 | Baker, II | 256/65.14 |
| 4,236,698 | A | | 12/1980 | Compte | |
| 4,646,807 | A | * | 3/1987 | Doublet | 160/135 |
| 4,669,577 | A | | 6/1987 | Werner | |
| 5,263,550 | A | | 11/1993 | Jines et al. | |
| 5,314,167 | A | | 5/1994 | Holloman | |
| 5,595,230 | A | * | 1/1997 | Guerra | 135/900 |
| 6,038,829 | A | | 3/2000 | Franks | |

FOREIGN PATENT DOCUMENTS

| | | |
|---|---|---|
| JP | 1-203557 | 2/1989 |

* cited by examiner

*Primary Examiner*—Lynne H. Browne
*Assistant Examiner*—Jori Schiffman
(74) *Attorney, Agent, or Firm*—Burns, Doane, Swecker & Mathis, LLP

(57) ABSTRACT

A safety fence system provides a quick and easy way to attach, adjust, move, and remove safety railings at a construction site. The safety fence system is completely reusable and includes a plurality of fence post brackets and a plurality of fence panels. The fence post brackets each connect to a concrete slab or other floor of a building under construction by a C-shaped clamp member. The fence panels, such as chain link fence panels, are easily connected to the fence post brackets by slipping tubular end posts of the fence panels over short pipes on the clamp member.

19 Claims, 2 Drawing Sheets

PORTABLE SAFETY FENCE SYSTEM FOR CONSTRUCTION SITES

CROSS REFERENCE TO RELATED APPLICATIONS

This application claims priority to U.S. Provisional Patent Application Serial No. 60/193,562 filed on Mar. 31, 2000, which is incorporated herein by reference in it's entirety.

BACKGROUND OF THE INVENTION

The invention relates to a portable safety fence system for use at construction sites, and more particularly, the invention relates to a safety fence bracket for connecting portable fence panels to the edge of an elevated concrete slab.

During construction of multi-level buildings, safety railings are generally installed along the edges of the building to prevent falls from the building prior to completion of the building walls. On many construction sites, a system of wooden 2×4 railings is installed along the edges of the building at each floor. This wooden 2×4 safety fence system must be constructed specifically for each building and is dismantled and discarded after use.

U.S. Pat. Nos. 3,867,997; 3,863,899; and 4,236,698 describe some of the removable safety rail systems. However, these systems do not provide an easily assembled and disassembled system of fence panels and fence panel brackets which are specifically designed to be used together as a system and removed for reuse.

Accordingly, it would be desirable to provide a portable safety fence system which is easily attached and removed from a construction site and is completely reusable.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF PREFERRED EMBODIMENTS

Figure 1:
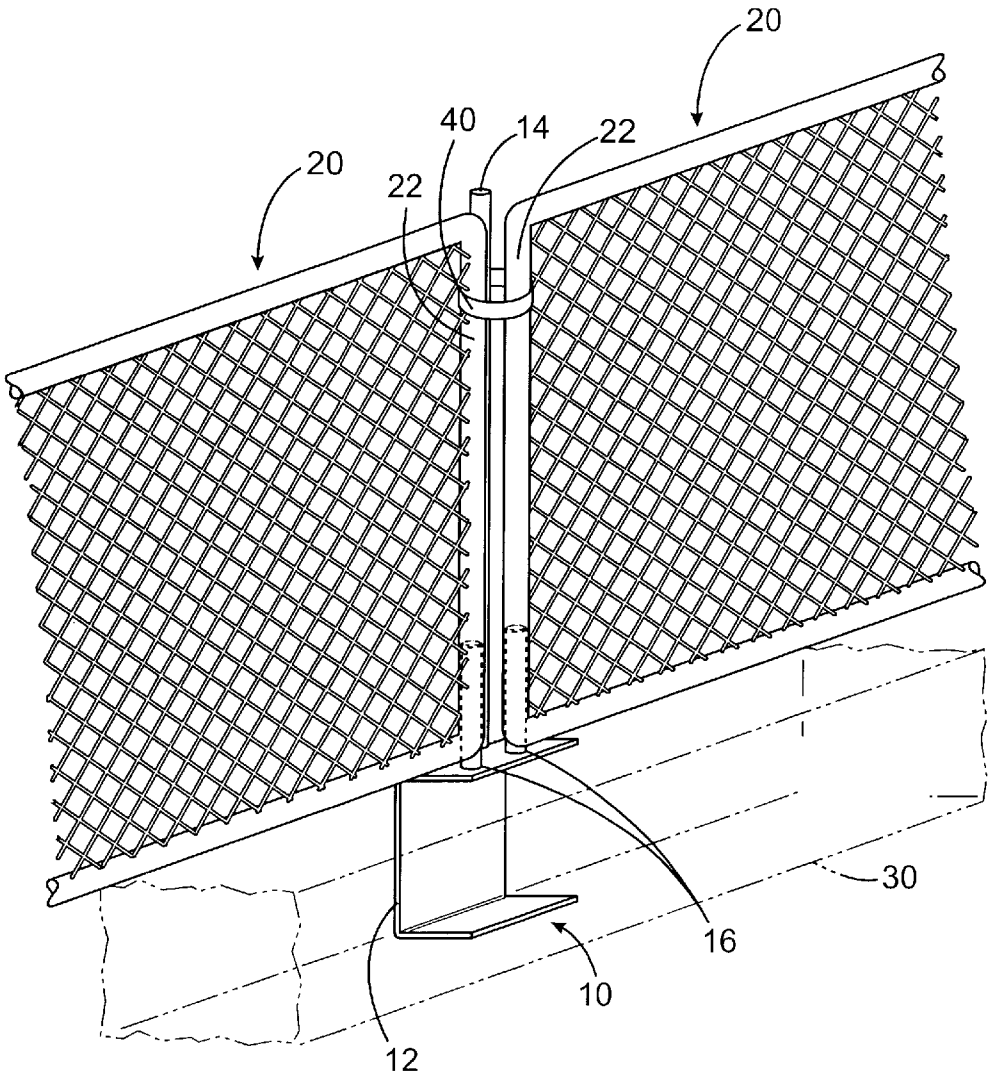
FIG. 1 is a perspective view of a portable safety fence system according to the present invention.

FIG. 1 shows the portable safety fence system according to the present invention. The safety fence system provides a quick and easy way to attach, adjust, move, and remove safety railings at a construction site. The safety fence system is completely reusable and includes a plurality of fence post brackets 10 and a plurality of fence panels 20. The fence post brackets 10 each connect to a concrete slab 30 (shown in hidden lines in FIG. 1) or other floor of a building under construction. The fence panels 20, such as chain link fence panels, are easily connected to the fence post brackets 10.

Figure 2:
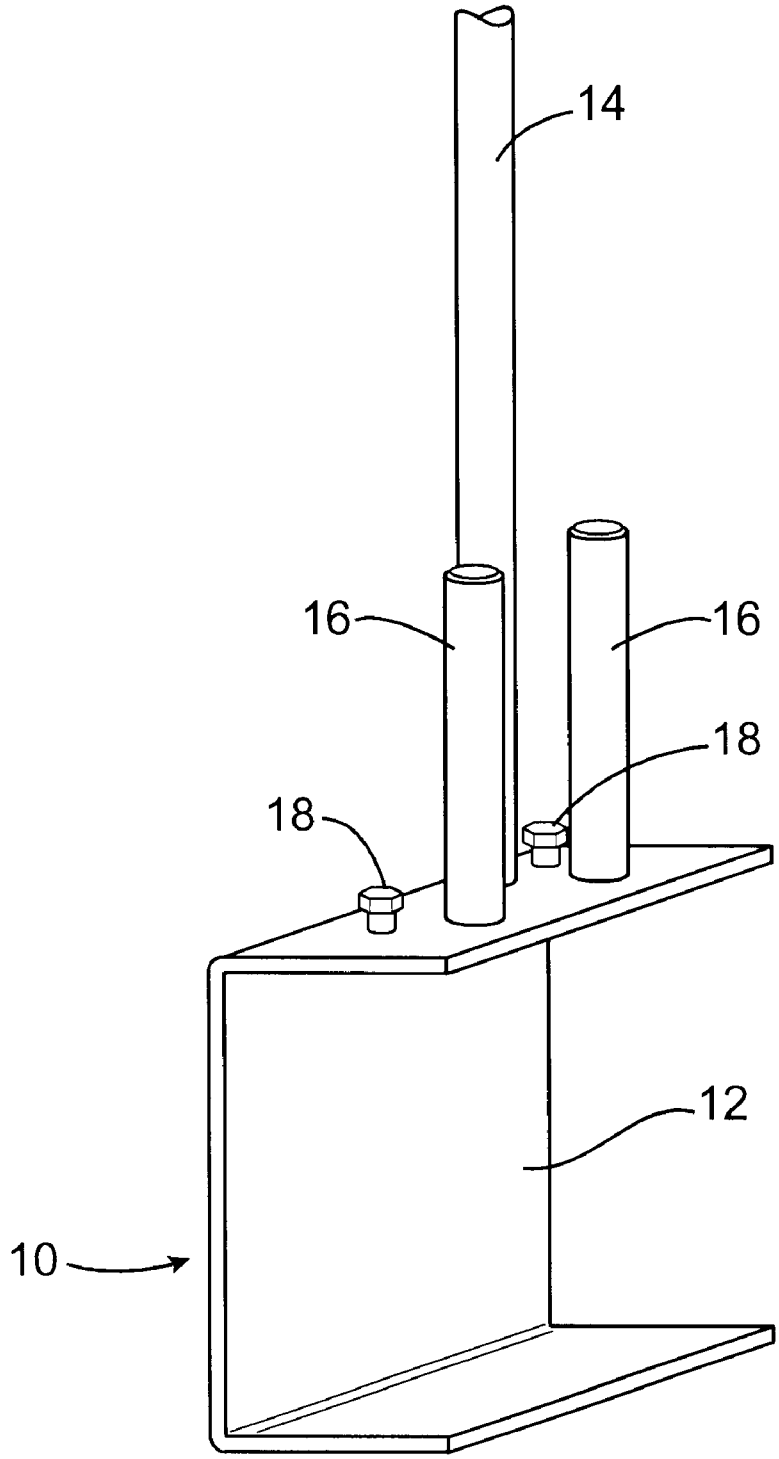
FIG. 2 is a perspective view of the fence post bracket of the portable safety fence system of FIG. 1.

The fence post brackets 10, as shown in FIGS. 1 and 2, include a clamp member 12 configured to attach to the floor 30 of a building, a fence post 14 extending from the clamp member, and two short pipes 16 extending from the clamp member. The fence post 14 and the two short pipes 16 are fixed to a first surface of the clamp member 12. The clamp member 12 is preferably a C-shaped clamp member having two tightening members 18, shown only in FIG. 2. The tightening members 18 are illustrated as two bolts, however other numbers and configurations of tightening members may also be used. The bolts 18 may be easily tightened to secure the fence post bracket 10 to the floor 30 and loosened to remove the fence post bracket.

The short pipes 16 are arranged on either side of the fence post 14 for receiving the fence panels 20. Preferably, the short pipes 16 have a length of about 4–10 inches. The short pipes 16 are preferably arranged along a line which is spaced about 2–6 inches toward an open end of the C-shaped clamp member 12 from the fence post 14.

The fence panels 20 are attachable to the fence post bracket in a removable, replaceable, and reusable manner. The fence panels 20 have end posts 22 with openings which receive the short pipes 16 to connect the fence panels to the fence post brackets 10. The openings in the end posts 22 allow the fence panels 20 to be attached to the fence post brackets 10 by slipping the end posts of the fence panels over the short pipes 16 of the fence post brackets.

The safety fence system according to the present invention may be connected to concrete slabs, steel beams, or other structures. The fence panels 20 for use with the present invention may be the chain link fence panels which are shown, metal or wooden rail fence panels, or other fence panels.

Although the safety fence system has been illustrated as positioned on a straight section of a building, it should be understood that the fence system can easily accommodate curved building floors and corners by pivoting the fence panels 20 on the short pipes 16.

Preferably, a top of the fence panels 20 is secured to the fence post 12 by a fence clamp 40 of any known configuration.

According to one example, the fence post brackets 10 were formed as follows. The clamp member 12 was made up of an about ⅜ inch thick steel plate that was about 10" by about 18⅞" in size. The plate was bent into a channel or C-shape, with the upper flange of the channel at approximately an 85 degree angle with the vertical web. The lower flange was at about a 90 degree angle with the web. Each channel measured about 4⅞" long and the vertical web measured about 9⅛" high.

This clamp member 12 was then fitted with two clamping nuts ½" in diameter. The nuts were placed about 3¾ inches in from the edge of the plate and about 2" from the vertical web. An approximately 48" long schedule 40 pipe, about 1" in diameter, was welded to the plate centered between the two clamping bolts to form the fence post 14. Two about 6" long pieces of pipe were welded 3-58" apart on a axis that was about 4⅛" from the vertical web to form the short pipes 16. The entire fence post bracket 10 was then secured to a piece of heavy steel wide flange beam for testing.

Testing Description

Two 10' lengths of chain link safety fencing were attached to the bracket to be tested by slipping tubular end posts of the safety fencing directly over the welded short pipes of the bracket. The fencing was then clamped to the 48" vertical pipe on the bracket with fence clamps typically used for this purpose. A 200 pound load was then applied directly to the fence sections being held in place by the bracket being tested. The load was applied vertically, then horizontally at the top of the fencing. In both cases, the bracket withstood this load.

The 200 pound load was selected after referring to the CAL/OSHA Article 16, Standard Railings. This article states that this type of railing must withstand at least 13 pounds load per linear foot both horizontally and vertically. This would be the equivalent of 130 pounds load for a 10 foot section of supported fencing. Adding a safety factor, a 200 pound test load was selected.

As would be expected, there was some deflections noted during application of the horizontal load to the fence and bracket assembly. Minimal deflections were noted when the apparatus was tested with a vertical load. The average deflection measured during horizontal loading was approximately 2 inches at the top of the fence. This result was measured when the clamping nuts were wrenched tight. When the clamping nuts were only hand tightened, the deflection measure at the top of the fence increased to about 3.5 inches.

Based on testing performed on the apparatus described above, the safety fencing and bracket system tested will withstand a horizontal and vertical load of 200 pounds with horizontal deflections at the top of the 4' high fence as reported.

While the invention has been described in detail with reference to the preferred embodiment thereof, it will be apparent to one skilled in the art that various changes and modifications can be made and equivalence employed without departing from the present invention.

What is claimed is:

1. A safety fence system comprising:

a plurality of fence post brackets having a clamp member configured to attach to a floor of a building, a fence post extending from the clamp member, and two short pipes extending from the clamp member; and a plurality of fence panels attachable to the fence post bracket in a removable, replaceable, and reusable manner, the plurality of fence panels having end posts with openings which receive the short pipes to connect the fence panels to the fence post brackets.

2. The safety fence system of claim 1, wherein the fence post and the two short pipes are all fixed to a first surface of the clamp member.

3. The safety fence system of claim 2, wherein the clamp member is a substantially C-shaped clamp member with the first surface on a top of the C-shaped clamp member.

4. The safety fence system of claim 1, wherein the plurality of fence post brackets include a tightening member for securing the fence post brackets to the floor of a building.

5. The safety fence system of claim 1, wherein the short pipes have a height of about 4 to about 10 inches.

6. The safety fence system of claim 5, wherein the short pipes each have a height which is less than ⅓ of a height of the fence post.

7. The safety fence system of claim 1, further comprising a fence clamp for connecting a top of one or more of the fence panels to one or more of the fence post brackets.

8. The safety fence system of claim 1, wherein the plurality of fence panels are substantially rigid panels.

9. The safety fence system of claim 1, wherein the plurality of fence panels each have a height which is larger than a height of the short pipes.

10. A fence post bracket for a safety fencing system, the bracket comprising:

a C-shaped clamp member configured to attach to an edge of a building floor;

a fence post extending from the clamp for supporting a fence panel; and two short pipes extending from a same side of the clamp as the fence post for receiving fence panels in a removable, replaceable, and reusable manner, wherein the two short pipes each have a height which is less than ⅓ of a height of the fence post.

11. The safety fence system of claim 10, wherein the C-shaped clamp member includes a tightening member for securing the fence post bracket to the edge of a building floor.

12. The safety fence system of claim 10, wherein the two short pipes have a height of about 4 to about 10 inches.

13. A safety fence system comprising:

a plurality of fence post brackets having a clamp member configured to attach to a floor of a building, a fence post extending from the clamp member, and two short pipes extending from the clamp member;

a plurality of fence panels attachable to the fence post bracket in a removable, replaceable, and reusable manner, the plurality of fence panels having end posts with openings which receive the short pipes to connect the fence panels to the fence post brackets, and the plurality of fence panels each having a height which is larger than a height of the short pipes.

14. The safety fence system of claim 13, wherein the fence post and the two short pipes are all fixed to a first surface of the clamp member.

15. The safety fence system of claim 13, wherein the clamp member is a substantially C-shaped clamp member with the first surface on a top of the C-shaped clamp member.

16. The safety fence system of claim 13, wherein the plurality of fence post brackets include a tightening member for securing the fence post brackets to the floor of a building.

17. The safety fence system of claim 13, wherein the short pipes have a height of about 4 to about 10 inches.

18. The safety fence system of claim 13, wherein the short pipes each have a height which is less than ⅓ of a height of the fence post.

19. The safety fence system of claim 13, wherein the plurality of fence panels are substantially rigid panels.

* * * * *